US012808140B2

(12) United States Patent
White

(10) Patent No.: US 12,808,140 B2
(45) Date of Patent: Nov. 24, 2026

(54) DAMPENING ASSEMBLY FOR VIBRATORY PILE DRIVERS

(71) Applicant: Antaeus Foundation Equipment LLC, Seattle, WA (US)

(72) Inventor: John L. White, Seahurst, WA (US)

(73) Assignee: Antaeus Foundation Equipment LLC, Seattle, WA (US)

( * ) Notice: Subject to any disclaimer, the term of this patent is extended or adjusted under 35 U.S.C. 154(b) by 53 days.

(21) Appl. No.: 18/970,877

(22) Filed: Dec. 5, 2024

(65) Prior Publication Data

US 2025/0092629 A1 Mar. 20, 2025

Related U.S. Application Data

(63) Continuation-in-part of application No. 18/911,229, filed on Oct. 9, 2024, which is a continuation of application No. 17/692,681, filed on Mar. 11, 2022, now Pat. No. 12,116,744.

(51) Int. Cl.
*E02D 11/00* (2006.01)
*E02D 7/18* (2006.01)

(52) U.S. Cl.
CPC ..... *E02D 11/00* (2013.01); *E02D 7/18* (2013.01)

(58) Field of Classification Search
CPC ..... E02D 7/18; E02D 11/00; E02D 13/00; E02D 7/00
See application file for complete search history.

(56) References Cited

U.S. PATENT DOCUMENTS

| | | | |
|---|---|---|---|
| 2,713,791 | A | 7/1955 | Stewart |
| 5,263,544 | A | 11/1993 | White |
| 5,522,680 | A | 6/1996 | Hoss et al. |
| 7,080,958 | B1 | 7/2006 | Morris |
| 9,567,192 | B2 | 2/2017 | Tuenkers |

OTHER PUBLICATIONS

U.S. Appl. No. 17/692,681, Final Rejection dated Jul. 13, 2023 (6 pgs).
U.S. Appl. No. 17/692,681, Non-Final Rejection dated Apr. 13, 2023 (11 pgs).
U.S. Appl. No. 17/692,681, Non-Final Rejection dated Jan. 24, 2024 (6 pgs).

*Primary Examiner* — Sean D Andrish
(74) *Attorney, Agent, or Firm* — Matthew D. Thayne; Thayne and Davis LLC

(57) ABSTRACT

Dampening assemblies for crane systems and the like. In some embodiments, the assembly may comprise an upper connecting member and a lower connecting member. A first housing portion may be coupled to the upper connecting member and a second housing portion may be coupled to the lower connecting member. The assembly may further comprise opposing shock absorbing members removably connected between the first housing portion and the second housing portion. The opposing elastomer shock absorbing members may be configured to shear under the weight to move the first housing portion relative to the second housing portion to reduce vibration during operation.

20 Claims, 12 Drawing Sheets

DAMPENING ASSEMBLY FOR VIBRATORY PILE DRIVERS

CROSS-REFERENCE TO RELATED APPLICATIONS

This application is a continuation-in-part of co-pending application Ser. No. 18/911,229 filed on Oct. 9, 2024, and titled "DAMPENING ASSEMBLY FOR VIBRATORY PILE DRIVERS," which is a continuation of application Ser. No. 17/692,681 filed on Mar. 11, 2022, and titled "DAMPENING ASSEMBLY FOR VIBRATORY PILE DRIVERS." Each of the aforementioned applications is hereby incorporated herein by reference in its entirety.

TECHNICAL FIELD

This invention relates generally to vibratory pile drivers, and more particularly concerns damping mechanisms to reduce shaking and vibration of vibratory pile drivers during operation.

BACKGROUND OF THE INVENTION

During operation of certain vibratory pile drivers, shaking or vibration of the pile driver occurs, particularly during starting and stopping of operation, but during the entire operation as well. Such effects are undesirable, for both operators and users of such pile drivers. Various attempts have been made to reduce the shaking/vibration of such pile drivers during operation. One known arrangement is a suppressor system using elastomers, such as shown in U.S. Pat. No. 5,263,544 to White. Such arrangements include multi-stage systems using various elastomer arrangements, all in order to smooth out shaking/vibration during operation of pile drivers. Another arrangement to smooth out shaking is often referred to as damping or a dampening system. In one such arrangement, two opposing plates are arranged with a solid rubber barrel-like member connected between them, operating in compression. This arrangement has had some positive effect in reducing shaking action of pile drivers. An alternative to such a solid rubber arrangement uses an elastomer member in place of the solid rubber member, but also operating in compression which has been shown not to be effective. Further, if the elastomer fails in such an arrangement, the load falls.

Accordingly, an effective dampening system would be advantageous in the pile driving art.

SUMMARY OF THE INVENTION

Accordingly, disclosed is a dampening assembly for use in a pile driving system for pile driving and/or pile pulling, the dampening assembly comprising: a lower connecting member for connection to the vibratory device portion of a pile driving system; an upper connecting member for connecting to a crane assembly for the pile driving system, the upper connecting member connected to an outer housing for the dampening assembly; an inner assembly connected to the lower connecting member, the inner assembly including a safety pin extending through an opening in the outer housing, wherein the dampening assembly includes an inner housing connected to the outer housing; and opposing elastomer shock absorbing members connected between the inner assembly and extending to the inner housing, wherein in operation, weight on the dampening assembly results in a corresponding stretching of the opposing elastomer members, reducing vibration of the pile driving system during operation.

In an example of a dampening assembly according to some embodiments, the assembly may comprise an upper connecting member, such as a hook and/or shackle, configured to be coupled with a crane assembly and a lower connecting member configured to be releasably connected to a vibratory pile driver. The assembly may further comprise an outer assembly coupled to either the upper connecting member or the lower connecting member and an inner assembly coupled to either the lower connecting member or the upper connecting member. One or more elastomeric members, such as a pair of elastomeric members in some embodiments, may be coupled between the outer assembly and the inner assembly such that weight applied to the lower connecting member results in movement of the inner assembly relative to the outer assembly and shearing of the pair of elastomeric members to reduce vibration of the vibratory pile driver during operation. In preferred embodiments, the elastomeric members may be removably coupled with the assembly to allow for removal and replacement of the elastomeric members to extend the life, usability, and ease of use of the assembly.

In some embodiments, each elastomeric member may be slidably coupled between the outer assembly and the inner assembly. In some such embodiments, each elastomeric member of the pair of elastomeric members comprises a pair of opposing plates. An inner surface of the outer assembly may comprise a slot configured to removably receive a first plate of the pair of opposing plates, and an outer surface of the inner assembly comprises a slot configured to removably receive a second plate of the pair of opposing plates.

In some embodiments, one or more of the elastomeric members (in some cases, each elastomeric member) may be configured to be fixedly coupled with the dampening assembly using a single fastener, such as a single bolt and/or nut.

Some embodiments may further comprise a second pair of elastomeric members removably coupled between the outer assembly and the inner assembly.

In some embodiments, the outer assembly may comprise a pair of opposing plates and/or plate members. Similarly, in some embodiments, the inner assembly may comprise a single plate member positioned in between the pair of opposing plate members and movably coupled to both of the opposing plate members of the outer assembly.

Some embodiments may further comprise a safety member configured to prevent a failure of the pair of elastomeric members from causing the dampening assembly to release the vibratory pile driver. In some such embodiments, the safety member may extend between the opposing plate members and through an elongated slot formed in the single plate member. The safety member may then be configured to contact a lower portion of the elongated slot to prevent disconnection of the inner assembly and the outer assembly upon failure of the pair of elastomeric members.

In another example of a dampening assembly according to other embodiments, the assembly may comprise an upper connecting member configured to releasably connect to a crane assembly and a lower connecting member configured to releasably connect to a weight portion. The assembly may further comprise an inner housing and an outer housing movably coupled with the inner housing. One or more shock absorbing members may be connected between the inner housing and the outer housing, wherein, in operation, weight on the dampening assembly results in movement of the outer housing with respect to the inner housing, which movement results in a corresponding shearing of the at least one shock absorbing member, thereby reducing vibration of the weight portion during operation. In preferred embodiments, one or more of the shock absorbing members may be configured to be removed from the dampening assembly and replaced with a new shock absorbing member.

Some embodiments may further comprise a slot configured to slidably receive each of the shock absorbing members. In some such embodiments, the shock absorbing members may be configured to be slidably removed from the slots.

In some embodiments, each slot may be defined by opposing slot portions. In some such embodiments, a first slot portion of the opposing slot portions may be formed in the outer housing, and a second slot portion of the opposing slot portions may be formed in the inner housing.

Some embodiments may further comprise a pair of opposing plates coupled at opposing ends of each of the shock absorbing members. In some such embodiments, the pair of opposing plates may be configured to be slidably received in the slot.

Some embodiments may comprise a plurality of shock absorbing members. In some such embodiments, each shock absorbing member of the plurality of shock absorbing members may be configured to be removably coupled with the dampening assembly using a single fastener.

In some embodiments, the plurality of shock absorbing members may comprise a pair of opposing shock absorbing members. In some embodiments, each shock absorbing member may be coupled to an inner end plate at one end thereof. The inner end plate may be connected to the inner housing. Each shock absorbing member may further be coupled to an outer end plate at a second end thereof opposite the first end. The outer end plate may be connected to the outer housing.

In an example of a dampening assembly for use with a crane system subject to vibration according to some embodiments, the dampening assembly may comprise an upper connecting member for releasably connecting to the crane system and a first housing portion coupled to the upper connecting member. The assembly may further comprise a lower connecting member for releasably connecting to a weight and a second housing portion coupled to the lower connecting member. Opposing elastomer shock absorbing members may be connected, preferably removably connected, between the first housing portion and the second housing portion. The opposing elastomer shock absorbing members may be configured to shear under the weight to move the first housing portion relative to the second housing portion to reduce vibration during operation.

In some embodiments, each of the opposing elastomer shock absorbing members may be slidably received within a slot configured to allow for removal and replacement of the opposing elastomer shock absorbing members.

In some embodiments, each of the opposing elastomer shock absorbing members may be configured to be locked into place within its respective slot using a single fastener.

In some embodiments, each slot may be defined by opposing slot portions. In some such embodiments, a first slot portion of each of the opposing slot portions may be formed in the first housing portion, and a second slot portion of the opposing slot portions may be formed in the second housing portion. In some such embodiments, the first housing portion may comprise an inner housing portion, and the second housing portion may comprise an outer housing portion slidably coupled with the inner housing portion.

Some embodiments may further comprise a second pair of opposing elastomer shock absorbing members. In some such embodiments, the second pair of opposing elastomer shock absorbing members may be positioned adjacent to and at the same height along an elongated axis of the outer housing portion.

In an example of a method for dampening vibratory forces associated with a weight, such as a vibratory pile driver, according to some implementations, the method may comprise coupling a dampening assembly between a line, such as a crane system line, and a weight, such as a vibratory pile driver. The dampening assembly may comprise one or more shock absorbing members and/or elastomer members. The method may further comprise removing the shock absorbing members and/or elastomer members from the dampening assembly and replacing the shock absorbing members and/or elastomer members with new shock absorbing members and/or elastomer members, which may be part of a maintenance and/or repair process.

In some implementations, the shock absorbing members and/or elastomer members may be slidably removed from the dampening assembly. In some cases, the shock absorbing members and/or elastomer members may be slidably removed from the dampening assembly by sliding one or more plate members, such as opposing plate members, of the shock absorbing members and/or elastomer members out of one or more slots formed in the dampening assembly. In some cases, the one or more slots may comprise a first slot or slot portion formed in an inner housing piece and/or housing assembly of the dampening assembly and a second slot or slot portion formed in an outer housing piece and/or housing assembly of the dampening assembly. In some cases, the first slot and/or slot portion may be moveable and/or translatable with respect to the second slot and/or slot portion.

In some implementations, the step of removing and/or replacing the shock absorbing members and/or elastomer members may be done without the use of any bolts or other fasteners. In other cases, the step of removing and/or replacing the shock absorbing members and/or elastomer members may be done using only a single bolt or other fastener per shock absorbing member and/or elastomer member.

The features, structures, steps, or characteristics disclosed herein in connection with one embodiment may be combined in any suitable manner in one or more alternative embodiments.

DETAILED DESCRIPTION

Figure 1:
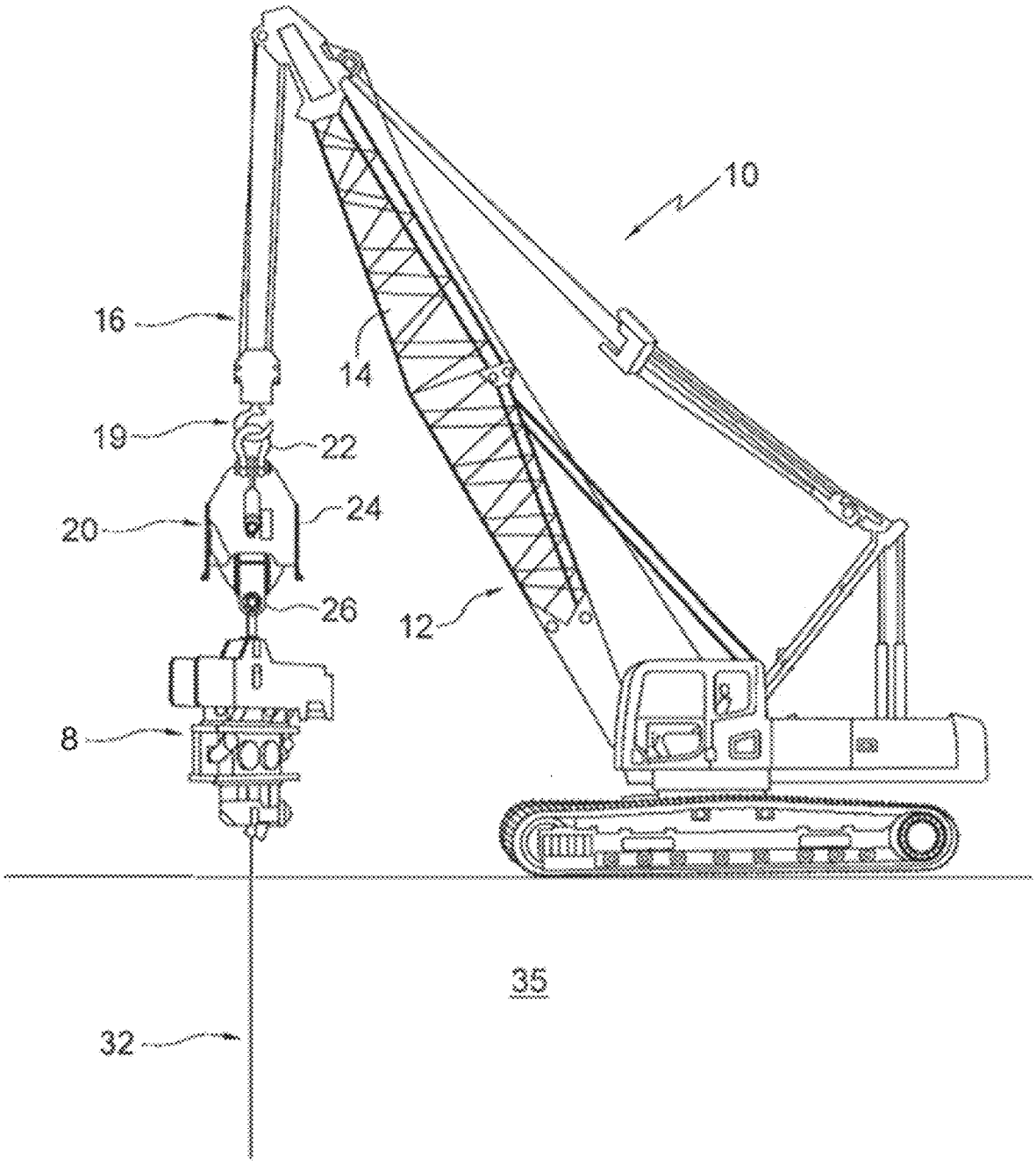
FIG. 1 is a perspective view of a vibratory pile driving system, showing the dampening assembly of the present invention.
Figure 2:
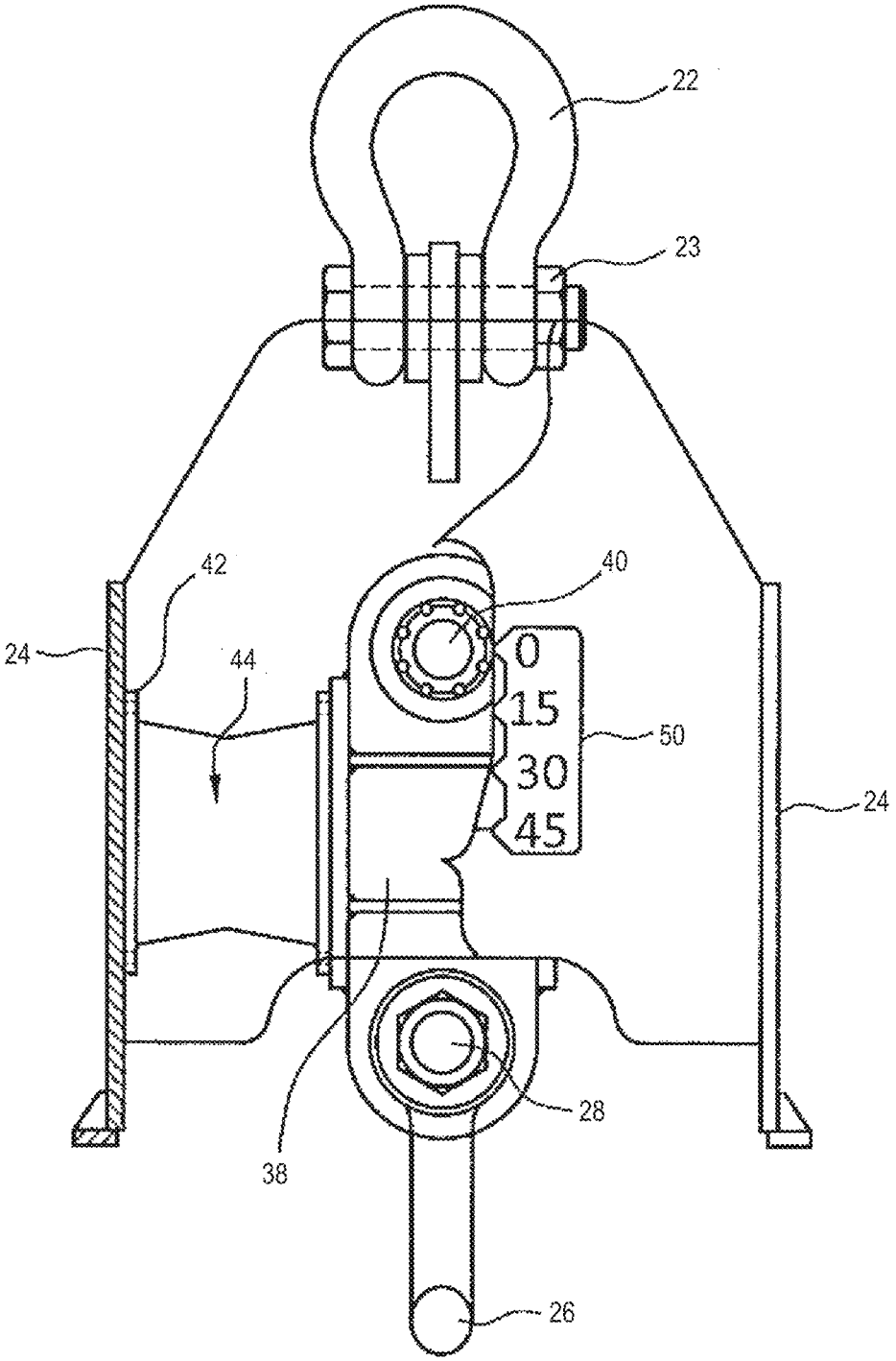
FIG. 2 is an elevational, partially cutaway, view of the dampening assembly of the present invention, without force on the dampening assembly.
Figure 3:
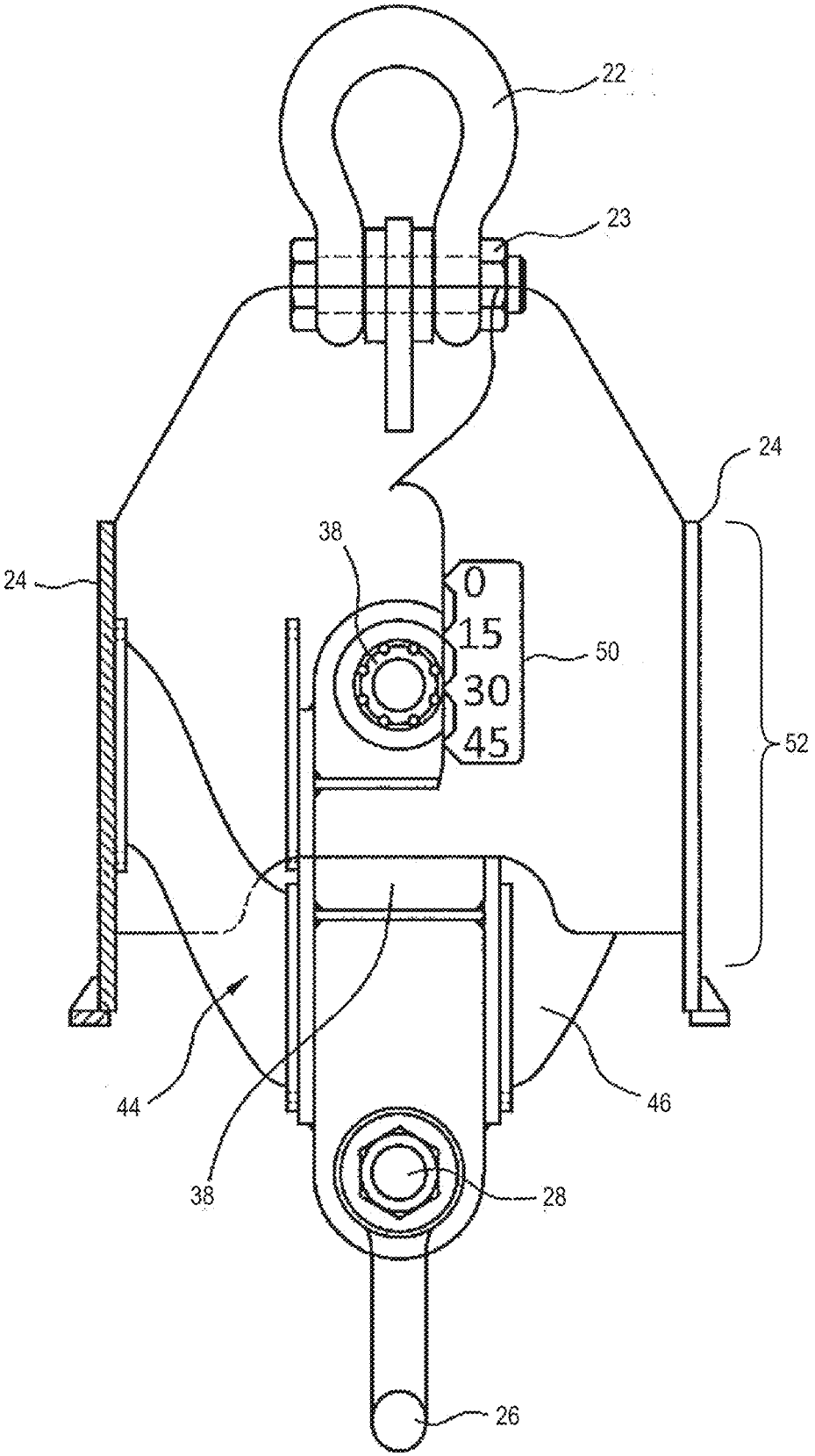
FIG. 3 is an elevational, partially cutaway, view of the dampening assembly, with significant weight on the assembly.

Referring now to FIGS. 1-3, a vibratory pile driver system is shown generally at 10. The system includes a conventional construction crane 12 with an extended boom 14 and a crane line shown at 16. At the end of crane line 16 is a crane hook 19 which is connected to the dampening assembly 20 of the present invention, by a first shackle member 22 which is bolted by assembly 23 to an outer housing member 24 of the dampening assembly 20. A second shackle member 26, positioned at 90 degrees to the first shackle member 22, is connected to a vibratory pile driver (vibro) 8, which operates on a pile 32 in the soil 35. The operation/purpose of the arrangement of FIG. 1, including the dampening assembly 20, is to reduce, even significantly reduce, the transfer of vibrations of the vibratory pile driver 8 into the crane line 16 and boom 14. Referring now to FIGS. 2 and 3, the second shackle 26 is connected by a bolt assembly 28 to an inner assembly 38, which includes a pin 40. The inner assembly 38 includes an inner housing 42 which is connected to the outer housing 24. Opposing elastomer shock absorbing members 44 and 46 include inner end plates bolted to the inner assembly 38, extending to the inner housing 42 to which they are also bolted by outer end plates. The elastomeric members 44 and 46 are conventional and well known in the pile driver shock absorbing art. The opposing elastomer members 44 and 46 stretch together during operation of the pile driver. The dampening assembly also includes a weight measuring scale 50 for convenience, but which is not essential for the operation of the dampening assembly. In the embodiment shown, the scale includes weights at 15-ton increments from zero through 45 tons, although the scale could differ in the specific weights measured.

Figure 4C:
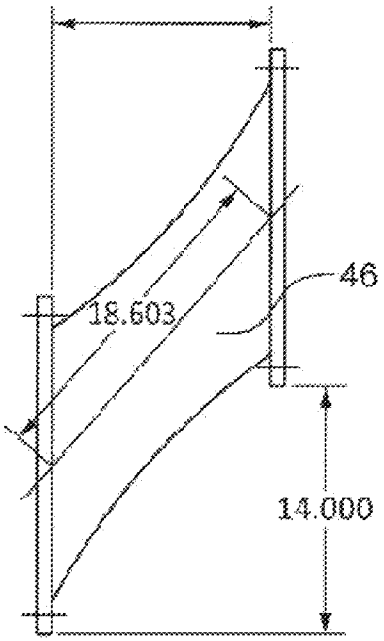
FIG. 4C is a simplified elevational view showing stretching of the elastomer members to 14 inches.
Figure 4B:
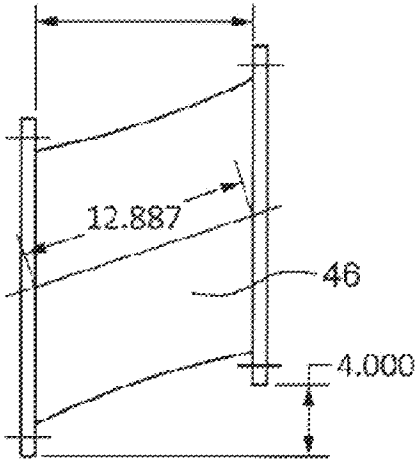
FIG. 4B is a simplified elevational view showing stretching of the elastomer members to 4 inches.
Figure 4A:
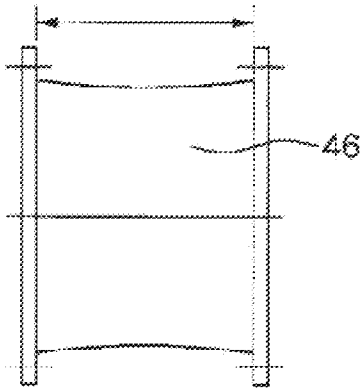
FIG. 4A is a simplified elevational view showing the stretching of the elastomer members of the dampening assembly without any elastomer stretching.

In operation, as weight is applied, the elastomers operate in shear, which is a significant difference relative to other available damping systems which use elastomer(s) operating in compression. Operation of the elastomers in shear is an important aspect of the present invention. FIGS. 4A, 4B and 4C show the condition of the elastomers stretching under 3 weight conditions. In the arrangement shown, the distance between the inner and outer end plates in the elastomers is 12.25 inches, which could be varied. FIG. 4A shows the elastomers under a static (no weight) condition. FIG. 4B shows the elastomers stretched to a length of 13 inches with 4.0 inches of relative movement of the inner assembly produced by 8 tons of weight as an example, while FIG. 4C shows the stretched condition of the elastomers with 14 inches of movement, and a stretched length of 18.6 inches produced by 30 tons of weight. These conditions will vary depending on the weight applied.

It is also important to recognize that with the arrangement of the present invention, if the weight results in a failure or tearing of the elastomers, pin 40 falls to its lowest position in the outer housing, as shown in FIG. 1, but maintains the connection with the vibro so that operation can continue, although shaking/vibration will occur due to the lack of the dampening protection.

It should also be recognized that weights 52 of various amounts can be connected to the exterior of the outer housing, shown on one side only.

Accordingly, a dampening assembly has been disclosed which uses elastomers in a shear arrangement to modulate or modify shaking/vibration during operation of a vibratory pile driver.

Figure 5:
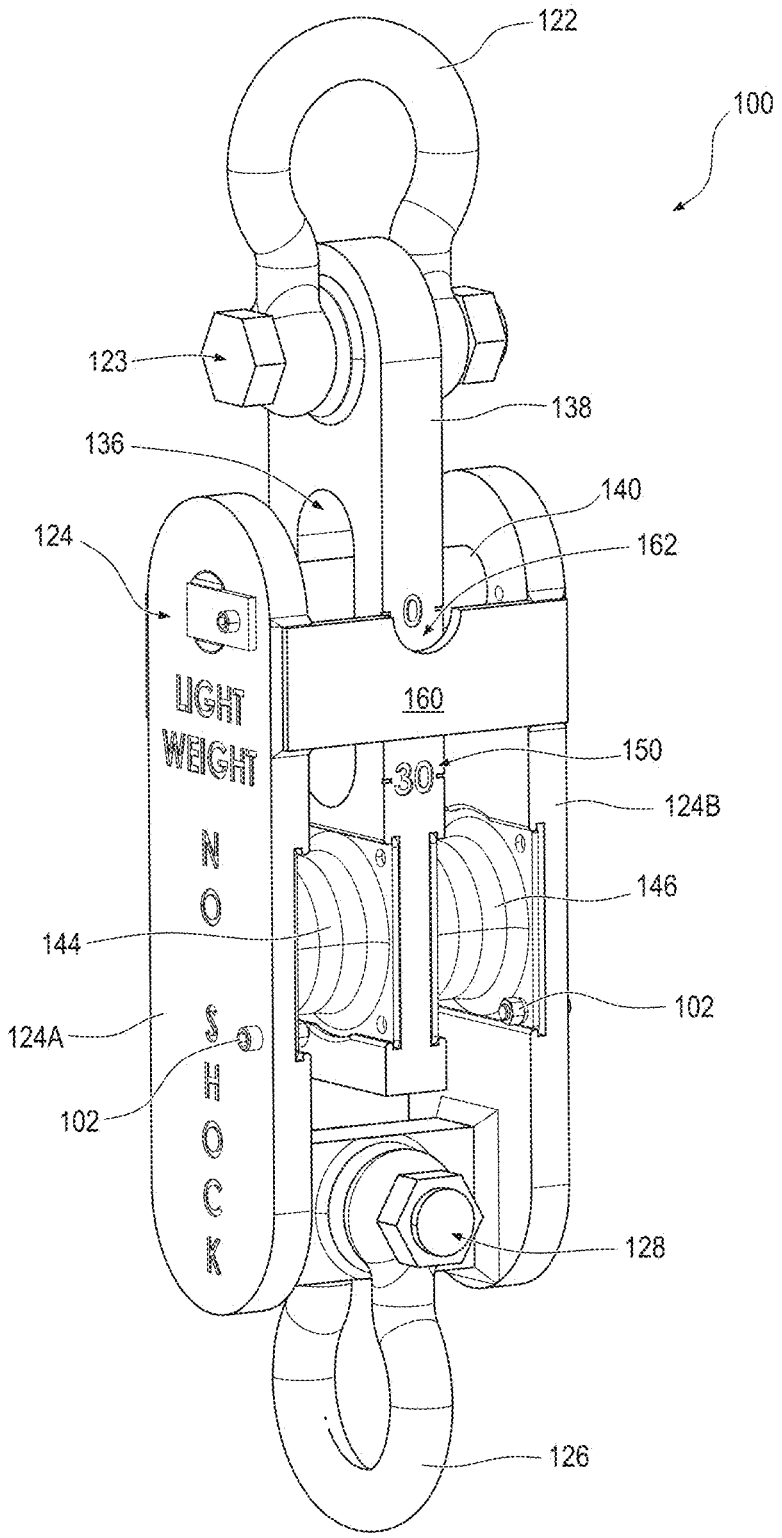
FIG. 5 is a perspective view of an alternative embodiment of a dampening assembly comprising removeable and replaceable elastomer members.

FIGS. 5-8 illustrate an alternative dampening assembly 100 according to other embodiments. In FIG. 5, a perspective view of dampening assembly 100 is provided. As shown in this figure, as with other embodiments described above, dampening assembly 100 comprises an upper connecting member 122 and a lower connecting member 126. As previously mentioned, upper connecting member 122 and/or lower connecting member 126 may comprise, for example, a shackle. Preferably, upper connecting member 122 and/or lower connecting member 126 is configured to allow for releasably coupling with other elements of a crane and/or pile driving system, or the like.

For example, upper connecting member 122 may be configured to be releasably coupled to a crane hook of a crane line, as previously mentioned. Similarly, lower connecting member 126 may be configured to be releasably coupled with a vibratory pile driver operating on a pile.

Figure 6:
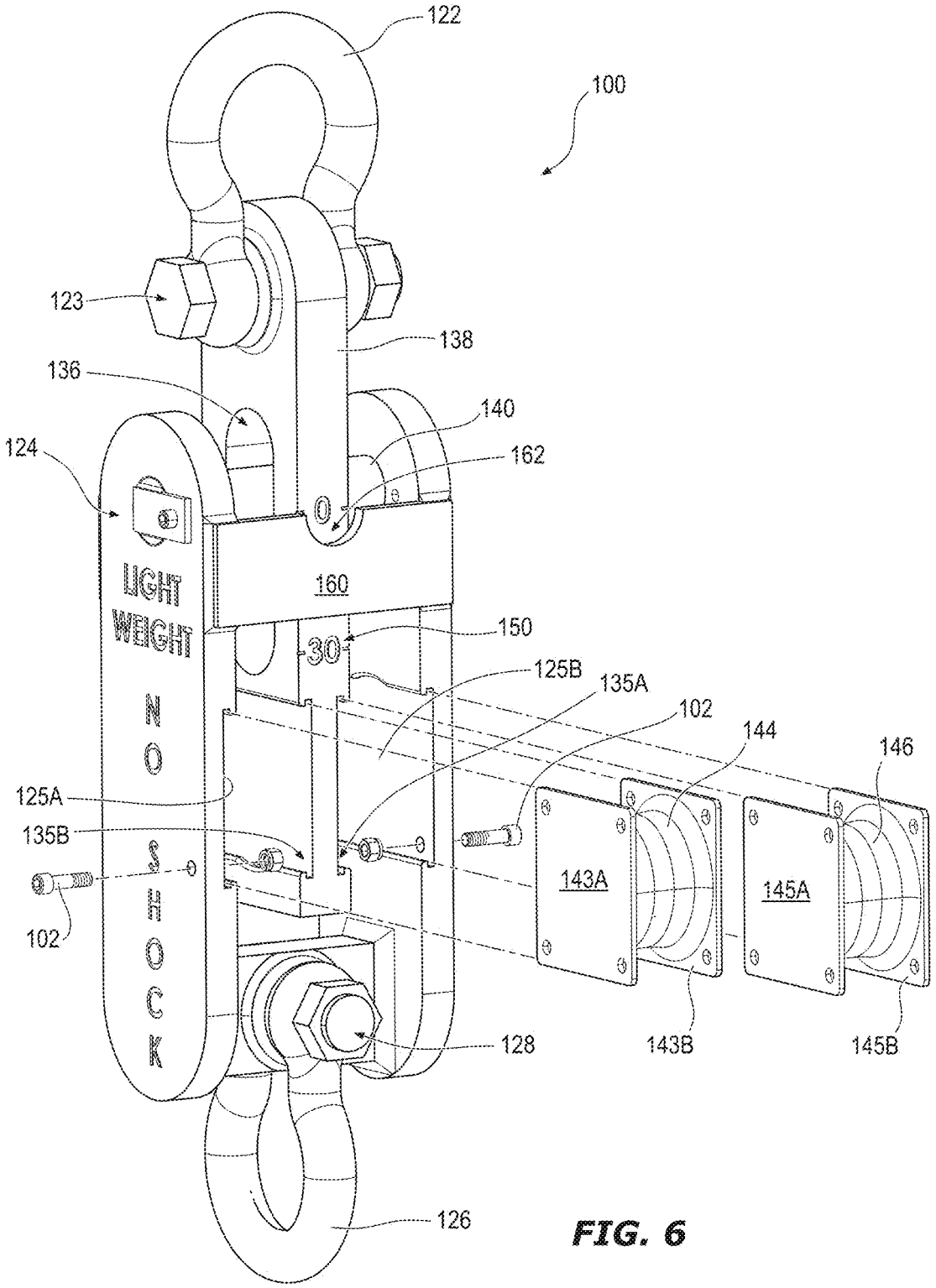
FIG. 6 is an exploded view of the dampening assembly of FIG. 5.

One or both of the connecting members 122/126 may be coupled to the assembly 100 using a respective fastener assembly 123/128, which may comprise a bolt assembly in some cases. As shown in FIG. 6, these two connecting members 122/126 comprise hook members that are rotated by ninety degrees relative to each other.

Upper connecting member 122 is coupled to an inner housing piece 138, which comprises an elongated inner plate in the depicted embodiment. An elongated slot 136 is formed in inner housing piece 138. A safety bar or safety pin 140 extends through slot 136 and is coupled between two opposing outer housing pieces 124A and 124B, together which form an outer housing assembly 124. As will be more apparent in consideration with later figures, the safety bar 140 is configured to contact the lower end of the slot 136 upon failure of one or both of the elastomer members 144/146. This feature therefore prevents, or at least inhibits, the possibility of such a failure resulting in releasing whatever weight has been applied to lower connecting member 126.

One or both of the outward facing spines of the inner housing piece 138 may comprise a weight measurement scale 150. Scale 150 may comprise a series of numbers spaced apart at distances corresponding to the amount that the inner housing piece 138 will move/slide relative to the outer housing assembly 124 with a given amount of weight applied to lower connecting member 126. These weights may, in some cases, correspond with tons of weight applied to lower connecting member 126.

A crossbar 160 may extend across and couple between the opposing outer housing pieces/members 124A/124B. In some embodiments, crossbar 160 may be configured to function in conjunction with scale 150 to allow a user to more readily view/read the current weight being applied to the assembly 100. For example, in the depicted embodiments, a groove 162 may be formed in the crossbar 160 at a central position and/or the general location of the inner housing piece 138 where the aforementioned weight figures are positioned. This may allow a user to more precisely view a specific weight figure on scale 150.

A pair of opposing elastomer members 144/146 is provided in order to reduce or eliminate vibrations from the weight applied to lower connecting member 126—such as weight from a vibratory pile driver—towards adjacent elements/structures, such as ground vibration transfer to adjacent structures, vibrations within the crane cab and/or operator controls, and the like.

Elastomer member 144 extends between outer housing piece 124A and inner housing piece 138. Similarly, elastomer member 146 extends between outer housing piece 124B and inner housing piece 138. As shown in FIG. 6, each elastomer member 144/146 is coupled to opposing plate members. Thus, elastomer member 144 is coupled between plate members 143A and 143B. Similarly, elastomer member 146 is coupled between plate members 145A and 145B.

Use of these plate members allows the elastomer members 144/146 to be slidably coupled to assembly 100 within slots formed within opposing parts of the assembly 100. More particularly, slot 125A—which is configured to receive plate member 143A of elastomer member 144—is formed along an inner surface of outer housing piece 124A and slot 135B—which is configured to receive plate member 143B of elastomer member 144—is formed along an opposing surface of inner housing piece 138. Similarly, slot 125B—which is configured to receive plate member 145B of elastomer member 146—is formed along an inner surface of outer housing piece 124B and slot 135A—which is configured to receive plate member 145A of elastomer member 146—is formed along an opposing surface of inner housing piece 138.

The elastomer mounting system of assembly 100 provides a simple, easy, and rapid way to remove and replace the elastomer members 144/146. In some embodiments, the assembly may reduce or eliminate the need for traditional fasteners, such as nuts and bolts, which are prone to rust and failure. By reducing or eliminating such fasteners, such embodiments may also further enhance safety by reducing the risk of load drops due to bolt/fastener failure. Preferred embodiments may further exclude the use of cables and/or wire rope, which may thereby offer a nearly maintenance-free and exceptionally reliable solution for vibration isolation in crane operations.

In the depicted dampening assembly 100, a single fastener 102 may be used to couple each of the various elastomer members. Thus, if desired, only a single fastener opening may be provided for each elastomer member. As shown in the figures, however, the plate members 143A/143B/145A/145B may have a corresponding fastener opening at each corner thereof, which may allow for replacement of an elastomer member without requiring a particular rotational alignment.

Although a single fastener 102 per elastomer member is used in the depicted assembly 100, it is contemplated that, in alternative embodiments, the elastomer members may be coupled without using any bolts or other fasteners. For example, a tight friction fit may be provided within the aforementioned slots configured for receiving the plate members to which the elastomer members are coupled. As another example, in some embodiments, a locking mechanism, such as an automated and/or resiliently movable locking door or wall may be provided on one or both ends of these slots. In some cases, a fixed wall may be provided at one end and a moveable door/wall at the other end to lock the plate members in place.

Figure 7:
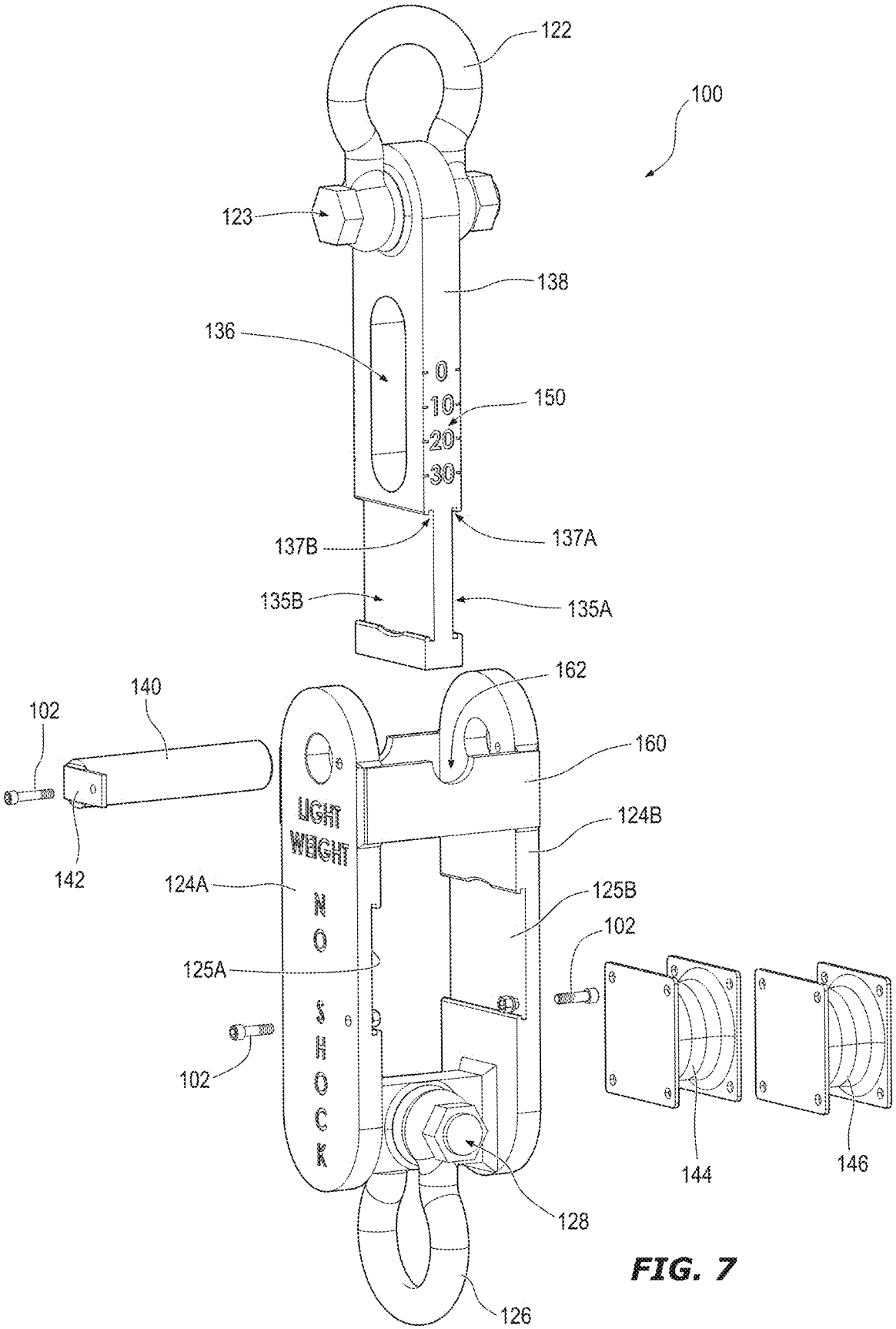
FIG. 7 is another exploded view of the dampening assembly of FIG. 5.

FIG. 7 better shows some additional features of assembly 100. For example, slots 125A/135B/135A/125B may comprise protruding lips to allow the plate members to be slid into place while restricting movement in directions perpendicular to the sliding direction. For example, upper protruding lips 137A and 137B are shown as defining the upper portion of the slots 135B and 135A, respectively. Although not specifically identified with reference numerals, the lower portion of slots 135B and 135A, along with the upper and lower portions of the other slots 125A/125B, also have protruding lips to facilitate the same purpose.

FIG. 7 also illustrates how safety member/bar 140 is coupled to assembly 100. A protruding coupling piece 142 extends from one end of safety member/bar 140 and is coupled to outer housing piece 124A using a fastener 102.

Figure 8:
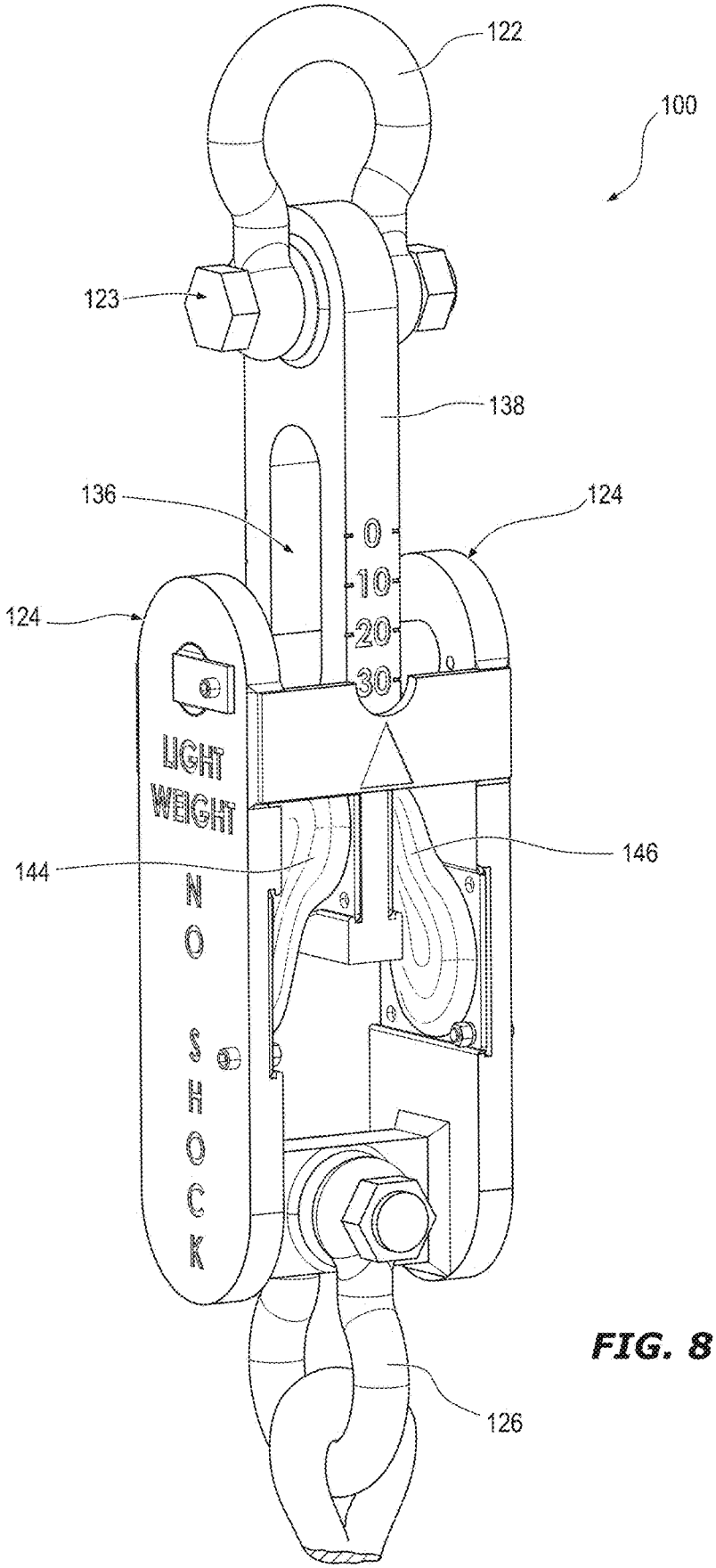
FIG. 8 is a perspective view showing the dampening assembly in use with a weight applied to the lower connecting member.

FIG. 8 shows assembly 100 during use with a weight coupled to lower connecting member 126. As shown in this figure, outer housing assembly 124 has moved downward relative to inner housing piece 138, thereby shearing elastomer members 144/146.

FIGS. 9-12 depict another dampening assembly 200 according to other embodiments. Many of the components of assembly 200 may be similar to assembly 100. For example, like dampening assembly 100, dampening assembly 200 comprises an upper connecting member 222 and a lower connecting member 226. Upper connecting member 222 and/or lower connecting member 226 are configured to allow for releasably coupling with other elements of a crane and/or pile driving system, or the like.

For example, upper connecting member 222 may be configured to be releasably coupled to a crane hook of a crane line, as previously mentioned. Similarly, lower connecting member 226 may be configured to be releasably coupled to a vibratory pile driver operating on a pile.

Figure 9:
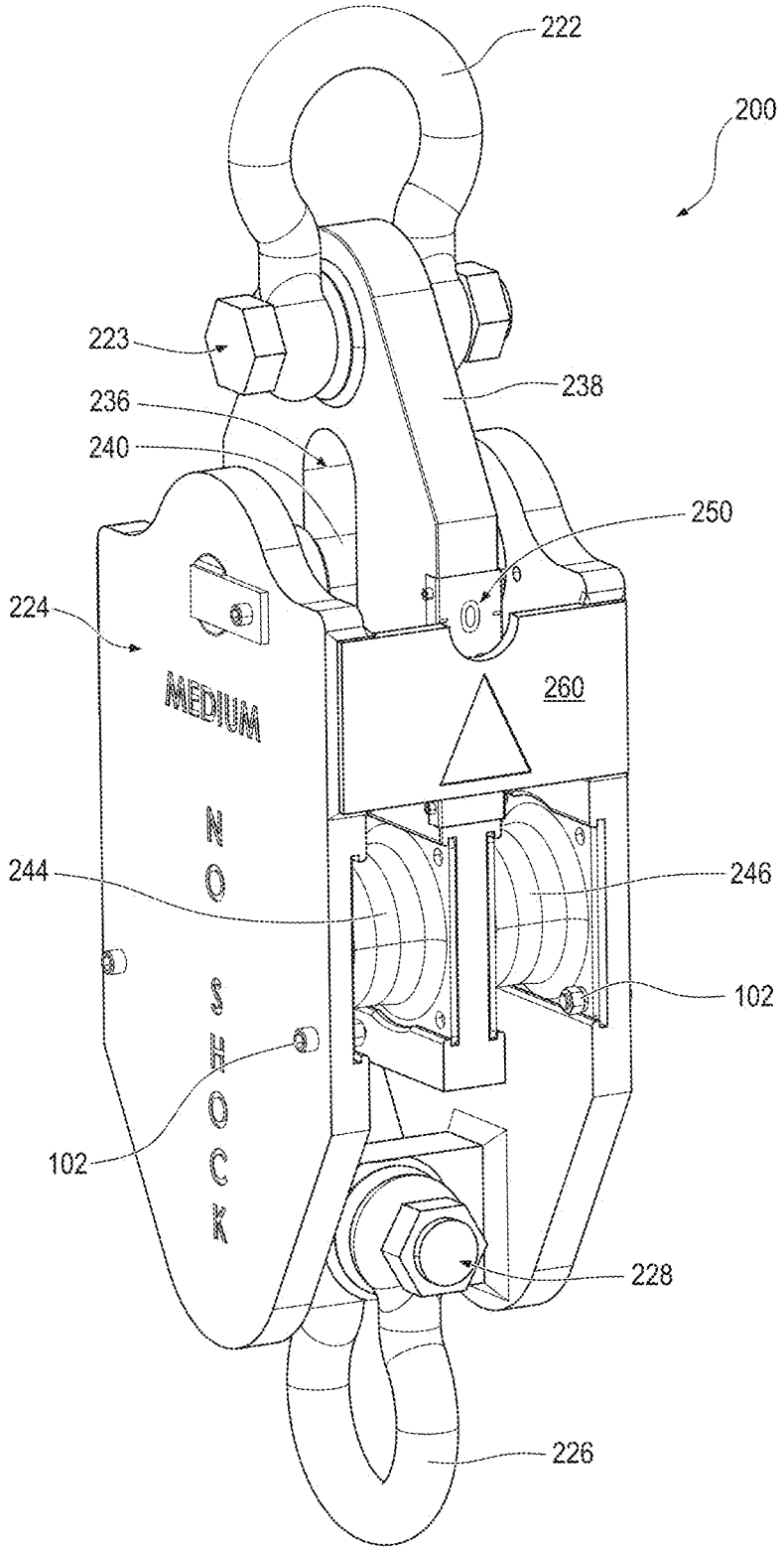
FIG. 9 is a perspective view of another alternative embodiment of a dampening assembly.

One or both of the connecting members 222/226 may be coupled to the assembly 200 using a respective fastener assembly 223/228, which may comprise a bolt assembly in some cases. As shown in FIG. 9, these two connecting members 222/226 comprise hook members that are rotated by ninety degrees relative to each other.

Figure 11:
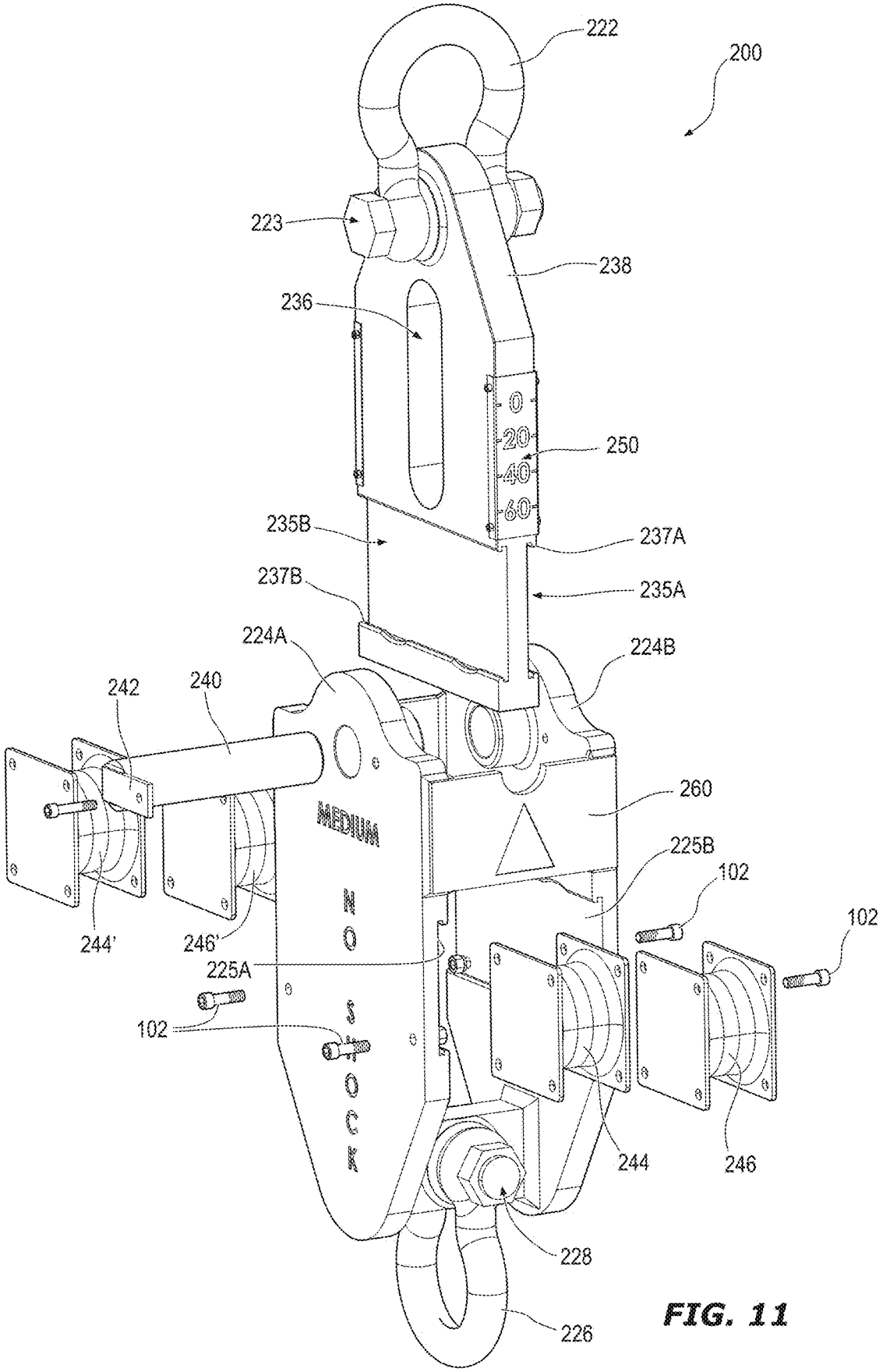
FIG. 11 is another exploded view of the dampening assembly of FIG. 9.

Upper connecting member 222 is again coupled to an inner housing piece 238, which comprises an elongated inner plate in the depicted embodiment. An elongated slot 236 is formed in inner housing piece 238. A safety bar or safety pin 240 extends through the slot 236 and is coupled between two opposing outer housing pieces 224A and 224B, together which form an outer housing assembly 224. Again, the safety member/bar 240 is configured to contact the lower end of the slot 236 upon failure of one or more of the elastomer members. In this case, however, there are four elastomer members. Elastomer members 244 and 246 are visible in FIG. 9. However, the exploded view of FIG. 11 depicts two additional elastomer members 244' and 246', both of which are configured to be positioned adjacent to another elastomer, namely, elastomer members 244 and 246, respectively.

Again, one or both of the outward facing spines of the inner housing piece 238 may comprise a weight measurement scale 250. A crossbar 260 extends across and couple between the opposing outer housing pieces/members 224A/224B. A groove may be formed in the crossbar 260 at a central position and/or the general location of the inner housing piece 238 where the aforementioned weight figures are positioned to allow a user to more precisely view a specific weight figure on scale 250.

Two pairs of opposing elastomer members 244/246 and 244'/246' are provided in order to reduce or eliminate vibrations from the weight applied to lower connecting member 226—such as weight from a vibratory pile driver—towards adjacent elements/structures, such as ground vibration transfer to adjacent structures, vibrations within the crane cab and/or operator controls, and the like. Because assembly 200 has twice as many elastomer members as assembly 100, it may be configured to handle, and dampen, significantly greater weights than assembly 100.

Of course, the number of elastomer members may vary as desired. Indeed, using the principles disclosed herein, those of ordinary skill in the art will be able to construct dampening assemblies to accommodate any number of elastomer members and therefore, within reason, any desired amount of weight/force. For example, in some contemplated embodiments, a single elastomer may be provided, preferably in a manner that allows for easy removal and replacement, as described herein. Similarly, in other contemplated embodiments, more than four elastomers may be provided. For example, additional opposing elastomers may be provided by extending the width of the inner housing piece/assembly and the outer housing pieces/assembly. Alternatively, or additionally, additional rows of elastomer members may be provided above and/or below the rows in the depicted embodiments.

Elastomer members 244 and 244' extend between outer housing piece 224A and inner housing piece 238. Similarly, elastomer members 246 and 246' extend between outer housing piece 224B and inner housing piece 238. As shown in several of the figures, each elastomer member is coupled to and extends between opposing plate members.

As previously described, such plate members allow the elastomer members 244/244'/246/246' to be slidably coupled to assembly 200 within slots formed within opposing parts of the assembly 200. More particularly, slot 225A—which is configured to receive the plate members of elastomer members 244 and 244' on one side—is formed along an inner surface of outer housing piece 224A. Similarly, slot 235B—which is configured to receive the opposing plate members of elastomer members 244 and 244'—is formed along an opposing surface of inner housing piece 238. Similarly, slot 225B—which is configured to receive the plate members of elastomer members 246 and 246' on one side—is formed along an inner surface of outer housing piece 224B. Similarly, slot 235A—which is configured to receive the opposing plate members of elastomer members 246 and 246'—is formed along an opposing surface of inner housing piece 238.

It should be understood that, although slots 225A, 225B, 235A, and 235B are each formed as a single slot configured to receive two separate elastomer members each in a side-by-side configuration, again, other possibilities are contemplated and/or would be apparent to those of ordinary skill in the art after having received the benefit of this disclosure. For example, separate slots may be provided for each elastomer member or elastomer member assembly (including mounting plates, for example), if desired.

As with the elastomer mounting system of assembly 100, the elastomer mounting system of assembly 200 provides a simple, easy, and rapid way to remove and replace the elastomer members 244/244'/246/246'. In some embodiments, the assembly may reduce or eliminate the need for traditional fasteners, such as nuts and bolts, which are prone to rust and failure. By reducing or eliminating such fasteners, such embodiments may also further enhance safety by reducing the risk of load drops due to bolt/fastener failure.

As previously mentioned, a single fastener 102 may be used to couple each of the various elastomer members. Thus, if desired, only a single fastener opening may be provided for each elastomer member and/or plate member. As shown in the figures, however, the plate members associated with each elastomer member may have a corresponding fastener opening at each corner thereof, which may allow for replacement of an elastomer member without requiring a particular rotational alignment.

Figure 10:
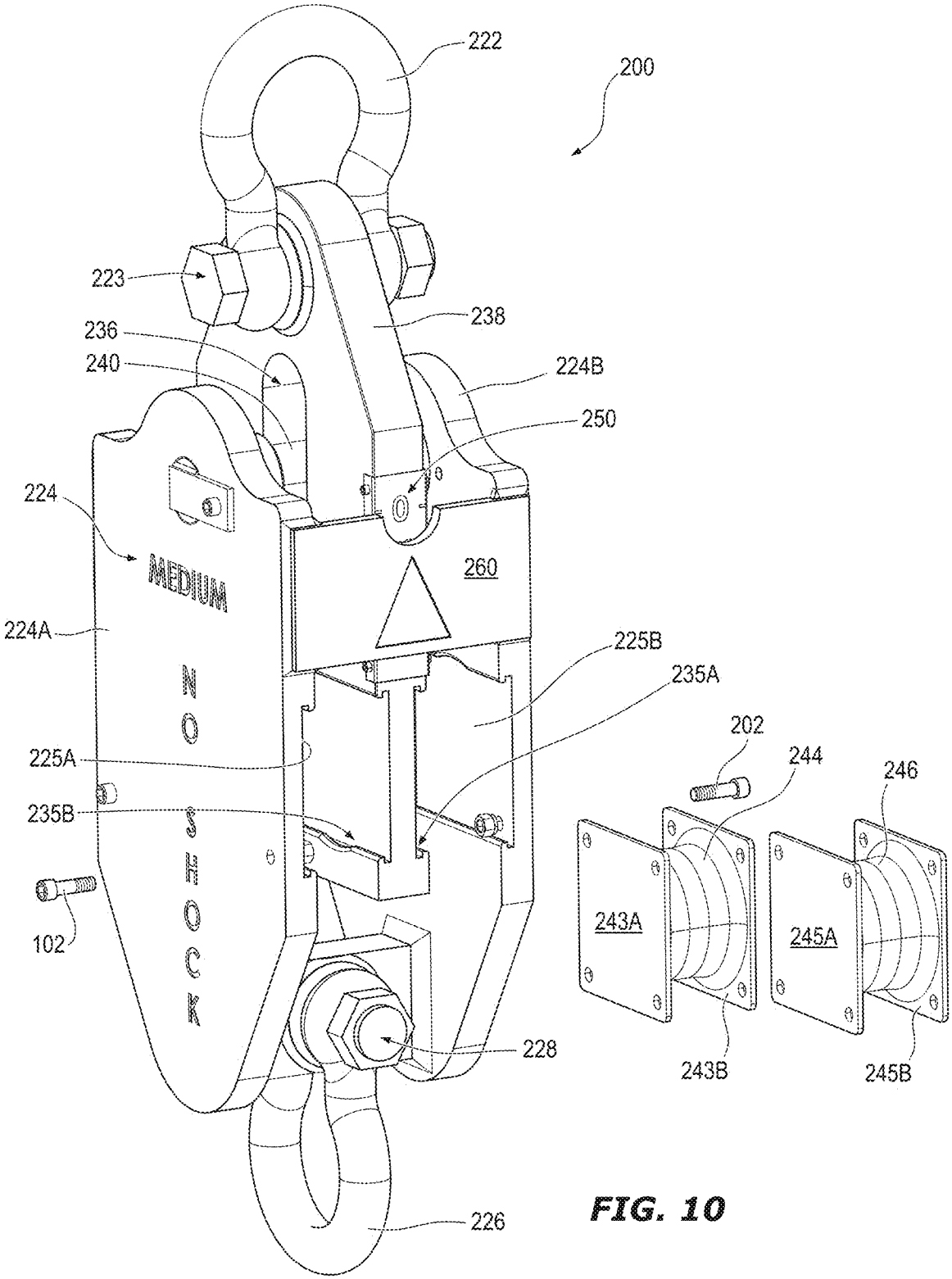
FIG. 10 is an exploded view of the dampening assembly of FIG. 9.

Thus, for example, as shown in FIG. 10, plate members 243A and 243B of elastomer member 244 each has four respective fastener openings-one at each corner.

Similarly, in the depicted embodiment, fastener openings are provided on both opposing plate members of each elastomer member. However, only a single fastener on a single side may be needed to mount each elastomer member. Thus, each plate member 245A and 245B of elastomer member 246 has four fastener openings-again, one at each corner. Thus, in the depicted embodiment, not only is the rotational configuration along an axis extending between the centers of the two opposing plate members irrelevant to proper mounting, but the rotational configuration along an axis perpendicular to the aforementioned axis may also be ignored. In other words, whether a particular plate member extends outward or inward need not be considered in the depicted examples.

Again, although a single fastener 102 per elastomer member is used in the depicted assembly 200, it is contemplated that, in alternative embodiments, the elastomer members may be coupled without using any bolts or other fasteners whatsoever. For example, a friction fit may be provided within the aforementioned slots configured for receiving the plate members to which the elastomer members are coupled. As another example, in some embodiments, a locking mechanism, such as an automated and/or resiliently movable locking door or wall may be provided on one or both ends of these slots. In some cases, a fixed wall may be provided at one end and a moveable door/wall at the other end to lock the plate members in place. For example, a sliding wall may be incorporated into the peripheral edges of one or more of the slots to allow for fixedly securing the elastomer members once they have been slid or otherwise positioned in place.

FIG. 11 illustrates how each of the various slots 225A/235B/235A/225B may comprise protruding lips to allow the plate members to be slid into place while restricting movement in directions perpendicular to the sliding direction. For example, upper protruding lip 237A is shown on slot 235A and lower protruding lip 237B is shown as defining the lower portion of slot 235B. Although not specifically identified with reference numerals, each of the other upper and lower portions of slots 225A/235B/235A/225B also have protruding lips to facilitate allowing the plate members of the elastomers to be slidably coupled with the dampening assembly 200.

FIG. 11 also illustrates how safety member/bar 240 is coupled to assembly 200. A protruding coupling piece 242 extends from one end of safety member/bar 240 and is coupled to outer housing piece 224A using a fastener 102.

Figure 12:
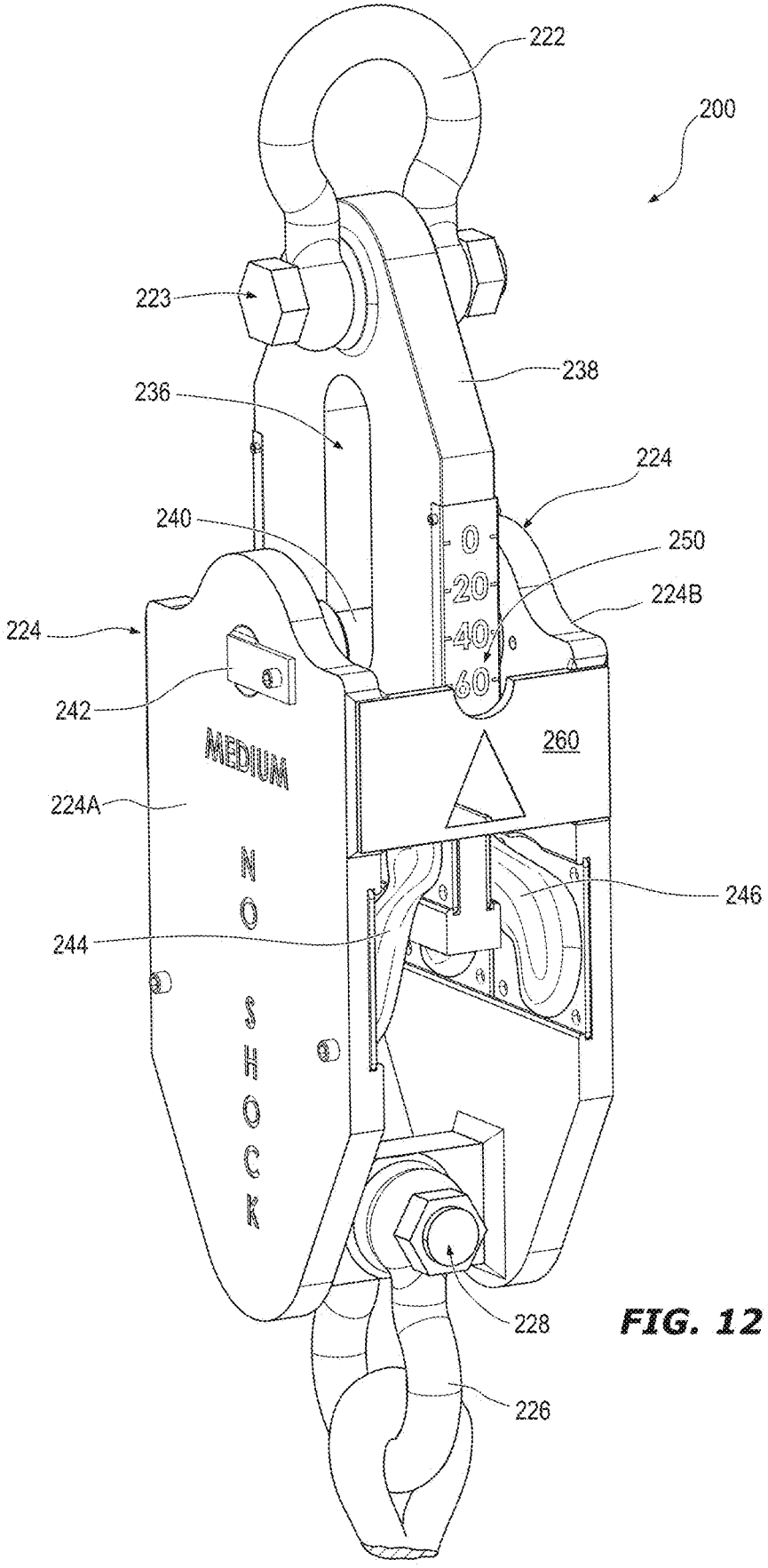
FIG. 12 is a perspective view of the dampening assembly in use with a weight applied to the lower connecting member.

FIG. 12 shows assembly 200 during use with a weight coupled to lower connecting member 226. As shown in this figure, outer housing assembly 224 has moved downward relative to inner housing piece 238, thereby shearing elastomer members 244/244'/246/246'.

Although a preferred arrangement of the present invention has been disclosed for the purpose of illustration, it should be understood that various changes, modifications, and substitutions may be incorporated without departing from the spirit of the invention which is defined by the claims that follow:

The invention claimed is:

1. A dampening assembly, comprising:

an upper connecting member configured to be coupled with a crane assembly;

a lower connecting member configured to be releasably connected to a vibratory pile driver;

an outer assembly coupled to either the upper connecting member or the lower connecting member;

an inner assembly coupled to either the lower connecting member or the upper connecting member; and a pair of elastomeric members removably coupled between the outer assembly and the inner assembly such that weight applied to the lower connecting member results in movement of the inner assembly relative to the outer assembly and shearing of the pair of elastomeric members to reduce vibration of the vibratory pile driver during operation, wherein each elastomeric member of the pair of elastomeric members is slidably coupled between the outer assembly and the inner assembly.

2. The dampening assembly of claim 1, wherein each elastomeric member of the pair of elastomeric members comprises a pair of opposing plates, wherein an inner surface of the outer assembly comprises a slot configured to removably receive a first plate of the pair of opposing plates, and wherein an outer surface of the inner assembly comprises a slot configured to removably receive a second plate of the pair of opposing plates.

3. The dampening assembly of claim 2, wherein each elastomeric member of the pair of elastomeric members is configured to be fixedly coupled with the dampening assembly using a respective single fastener.

4. The dampening assembly of claim 2, further comprising a second pair of elastomeric members removably coupled between the outer assembly and the inner assembly.

5. The dampening assembly of claim 2, wherein each slot comprises opposing protruding lips configured to permit sliding movement of a plate member of a corresponding elastomeric member in a sliding direction while restricting movement of the plate member in a direction perpendicular to the sliding direction.

6. The dampening assembly of claim 1, wherein the outer assembly comprises a pair of opposing plate members, and wherein the inner assembly comprises a single plate member positioned in between the pair of opposing plate members and movably coupled to both of the opposing plate members.

7. The dampening assembly of claim 6, further comprising a safety member configured to prevent a failure of the pair of elastomeric members from causing the dampening assembly to release the vibratory pile driver, wherein the safety member extends between the opposing plate members and through an elongated slot formed in the single plate member, and wherein the safety member is configured to contact a lower portion of the elongated slot to prevent disconnection of the inner assembly and the outer assembly upon failure of the pair of elastomeric members.

8. A dampening assembly, comprising:

an upper connecting member configured to releasably connect to a crane assembly;

a lower connecting member configured to releasably connect to a weight portion;

an inner housing;

an outer housing movably coupled with the inner housing;

at least one shock absorbing member connected between the inner housing and the outer housing, wherein in operation, weight on the dampening assembly results in movement of the outer housing with respect to the inner housing, which movement results in a corresponding shearing of the at least one shock absorbing member, thereby reducing vibration of the weight portion during operation, and wherein the at least one shock absorbing member is configured to be removed from the dampening assembly and replaced with a new shock absorbing member; and a slot configured to slidably receive the at least one shock absorbing member, wherein the at least one shock absorbing member is configured to be slidably removed from the slot.

9. The dampening assembly of claim 8, wherein the slot is defined by opposing slot portions, wherein a first slot portion of the opposing slot portions is formed in the outer housing, and wherein a second slot portion of the opposing slot portions is formed in the inner housing.

10. The dampening assembly of claim 9, further comprising a pair of opposing plates coupled at opposing ends of the at least one shock absorbing member, wherein the pair of opposing plates are configured to be slidably received in the slot.

11. The dampening assembly of claim 8, wherein the at least one shock absorbing member comprises a plurality of shock absorbing members, and wherein each shock absorbing member of the plurality of shock absorbing members is configured to be removably coupled with the dampening assembly using a respective single fastener.

12. The dampening assembly of claim 11, wherein the plurality of shock absorbing members comprises a pair of opposing shock absorbing members.

13. The dampening assembly of claim 8, wherein each shock absorbing member of the at least one shock absorbing member is coupled to an inner end plate at one end thereof, wherein the inner end plate is connected to the inner housing, wherein each shock absorbing member of the at least one shock absorbing member is coupled to an outer end plate at a second end thereof, and wherein the outer end plate is connected to the outer housing.

14. The dampening assembly of claim 8, further comprising a retention feature associated with the slot, wherein the retention feature is configured to retain the at least one shock absorbing member within the slot during operation while permitting selective slidable removal of the at least one shock absorbing member from the slot.

15. A dampening assembly for use with a crane system subject to vibration, the dampening assembly comprising:

an upper connecting member for releasably connecting to the crane system;

a first housing portion coupled to the upper connecting member;

a lower connecting member for releasably connecting to a weight;

a second housing portion coupled to the lower connecting member; and opposing elastomer shock absorbing members removably connected between the first housing portion and the second housing portion, wherein the opposing elastomer shock absorbing members are configured to shear under the weight to move the first housing portion relative to the second housing portion to reduce vibration during operation, wherein each of the opposing elastomer shock absorbing members is slidably received within a slot configured to allow for removal and replacement of the opposing elastomer shock absorbing members.

16. The dampening assembly of claim 15, wherein each of the opposing elastomer shock absorbing members is configured to be locked into place within a respective slot using a respective single fastener.

17. The dampening assembly of claim 15, wherein each slot is defined by opposing slot portions, wherein a first slot portion of each of the opposing slot portions is formed in the first housing portion, and wherein a second slot portion of the opposing slot portions is formed in the second housing portion.

18. The dampening assembly of claim 17, wherein the first housing portion comprises an inner housing portion, and wherein the second housing portion comprises an outer housing portion slidably coupled with the inner housing portion.

19. The dampening assembly of claim 18, further comprising a second pair of opposing elastomer shock absorbing members, wherein the second pair of opposing elastomer shock absorbing members is positioned adjacent to and at the same height along an elongated axis of the outer housing portion.

20. The dampening assembly of claim 15, wherein each of the opposing elastomer shock absorbing members comprises a pair of opposing plates configured to slidably couple the elastomer shock absorbing member with the first housing portion and the second housing portion.

* * * * *